United States Patent [19]

Krenkel et al.

[11] Patent Number: 4,832,090

[45] Date of Patent: May 23, 1989

[54] PAPER MAKING WIRE

[75] Inventors: Bernhard Krenkel; Fritz Vöhringer, both of Heidenheim, Fed. Rep. of Germany

[73] Assignee: F. Oberdorfer, Heidenheim, Fed. Rep. of Germany

[21] Appl. No.: 177,853

[22] PCT Filed: Jun. 13, 1985

[86] PCT No.: PCT/EP85/00280

§ 371 Date: Jan. 7, 1986

§ 102(e) Date: Jan. 7, 1986

[87] PCT Pub. No.: WO86/00099

PCT Pub. Date: Jan. 3, 1986

Related U.S. Application Data

[63] Continuation of Ser. No. 823,504, Jan. 7, 1986.

[30] Foreign Application Priority Data

Jun. 14, 1984 [EP] European Pat. Off. ..... 84106806.7

[51] Int. Cl.[4] ..... D03D 23/00

[52] U.S. Cl. ..... 139/383 A; 162/DIG. 1

[58] Field of Search ..... 139/383 A, 425 A, 408, 139/409, 410; 162/DIG. 1; 428/221, 223, 224, 225, 259

[56] References Cited

U.S. PATENT DOCUMENTS

| | | | |
|---|---|---|---|
| 2,047,542 | 7/1936 | Barrell | 139/410 |
| 2,209,874 | 7/1940 | Dempsey | 139/410 |
| 2,423,910 | 7/1947 | Snow et al. | 139/409 |
| 2,949,134 | 8/1960 | Hindle et al. | 139/383 A |
| 4,149,571 | 4/1979 | Burroughs | 139/383 A |
| 4,554,953 | 11/1985 | Borel et al. | 139/383 A |

FOREIGN PATENT DOCUMENTS

| | | | |
|---|---|---|---|
| 69101 | 1/1983 | European Pat. Off. | 139/383 A |
| 518231 | 2/1940 | United Kingdom . | |

*Primary Examiner*—Henry S. Jaudon

*Attorney, Agent, or Firm*—Morgan & Finnegan

[57] ABSTRACT

The invention is directed to a composite-type paper making wire or screen, comprising an upper or forming fabric and a lower or wear fabric including at least three sets of longitudinal threads and at least two sets of cross threads. Due to the imperfect nature of the paper-facing surface which results in all kinds of markings in the paper, paper making screens of this type are unsuited for the manufacture of fine papers. To eliminate this drawback, the screen is formed in such a way that at least half of all outwardly disposed longitudinal knuckles of the upper fabric (paper-facing side) of the screen are formed of two sets of longitudinal threads and that the first set of longitudinal threads is woven with the first set of cross threads, the third set of longitudinal threads is woven with the second set of cross threads, and at least portions of the second set of longitudinal threads are woven with both sets of cross threads.

11 Claims, 3 Drawing Sheets

PAPER MAKING WIRE

This is a continuation of co-pending application Ser. No. 823,504, filed on Jan. 7, 1986.

BACKGROUND OF THE INVENTION

The invention is directed to a paper making wire or screen in the form of a composite fabric, comprising an upper or forming fabric and a lower or wear fabric consisting of at least three sets of longitudinal threads or strands and at least two sets of cross threads or strands.

Until now, prior known paper making wires or screen in the form of composite fabrics could not be successfully used for making fine papers due to the imperfect nature of the upper surface facing the paper, which resulted in all kinds of markings in the paper. In this connection longitudinal, cross and diagonal markings have been known which were so severe that in most cases the wires had to be eliminated from the paper making machine.

A forming wire or screen for paper making machines is known which consists of a first set of warp threads and a first set of weft threads, woven to form a first complete fabric, and further consists of a second set of warp threads and a second set of weft threads woven to form a second complete fabric. The first and second fabrics are bound together by means of special binding weft threads disposed between the fabrics, the binding weft threads being tied up with threads from the first and second sets of warp threads. However, with this known screen, the intended object, viz. to have the binding weft threads extend rather straight in the fabric body, wherein they are wrapped by warp threads of the upper and the lower fabric so that the binding points should be within the fabric body and not at the outer threads thereof in order not to affect the flatness of the paper-facing side, has not been achieved. The binding weft threads do not extend linearly but are severely bent and form regularly disposed duplicate knuckles with the weft threads of the upper fabric on the paper-facing side of the wire; these duplicate knuckles form depressions in the upper surface which even include adjacent knuckles. Consequently, the above-mentioned drawbacks, i.e. severe markings which are unacceptable for many paper grades and especially for fine papers, are not eliminated.

It is also known in the art to provide a forming wire or screen comprising a fine-mesh side facing the paper web and a wide-mesh side acting as wear side, the wire or screen being in the form of complete fabrics bound together with special binding warp threads; however, in this known structure no information is given in respect of the distribution of the binding points and the influence thereof on the paper-facing side of the wire or screen; one must assume therefore, that with this known wire or screen the undulating extension of the warp threads on the paper-facing side will also result in the mentioned disadvantageous markings.

SUMMARY OF THE INVENTION

One object of the present invention, therefore, resides in improving the wear resistance of the above-specified paper making wire or screen, which should preferably be used for making fine papers.

Another objeet object of the invention resides in eliminating all of the problems concerning markings on the paper.

According to still another object of the invention, sufficient drainage capacity should be provided at the same time.

These and other objects are accomplished by providing a composite wire, screen or fabric having an upper fabric (paper-facing side) and a lower or wear fabric including at least three sets 1, 2 and 3 of longitudinal threads and at least two sets 4 and 5 of cross threads, characterized in that at least half of all outwardly disposed longitudinal knuckles of the upper fabric are constituted of sets 1 and 2 of longitudinal threads 7, 8, 9, 10 and 11 and that of the first set 1 of longitudinal threads is woven with the first set 4 of cross threads, the third set 3 of longitudinal threads is woven with the second set 2 of cross threads and at least portions of the second set 2 of longitudinal threads are woven with both sets 4 and 5 of cross threads.

In this way there is provided in the wire or screen according to the invention, that as many as possible, but at least half, of all outwardly disposed knuckles of the longitudinal threads of the upper fabric and, therefore, of the paper-facing side are double-woven. Thereby at least half of all the knuckles of the upper fabric instead of only a few ones are disturbed in the same way.

Thus, the paper making wire or screen in accordance with the invention constitutes a composite fabric with duplicate knuckles. In accordance with an advantageous modification of the invention, all of the externally disposed longitudinal knuckles of the upper fabric are formed from the first and second sets of longitudinal threads. Furthermore, it is advantageously possible to weave all of the threads of the second set of cross threads with threads of the second set of longitudinal threads, thus the sum of the binding forces is distributed to a maximum number of binding points, and the load on each single binding point is thereby minimized.

The knuckle distribution of the upper fabric and/or the lower fabric may correspond to a linen weave, and in accordance with a further improvement of the invention cross threads may additionally be woven with the lower fabric, such cross-threads 6 outwardly spanning at least three longitudinal threads (FIG. 3*a*). These additionally woven cross threads 6 may be made of a highly wear-resistant material.

Furthermore, it has been found beneficial that at least a portion of the second set of longitudinal threads be made from a high-elongation material and the diameter of the threads of the second set of longitudinal threads be designed to be not more than $\frac{3}{4}$ of the diameter of the threads of the first set of longitudinal threads.

Still further, the lower fabric may also be a Batavia wave (FIG. 4*a*).

DESCRIPTION OF THE DRAWINGS

A better understanding of the invention will be had by reference to the following detailed description when read in conjunction with the accompanying drawings, in which.

DETAILED DESCRIPTION OF THE PREFERRED EMBODIMENTS OF THE INVENTION

Figure 1A:
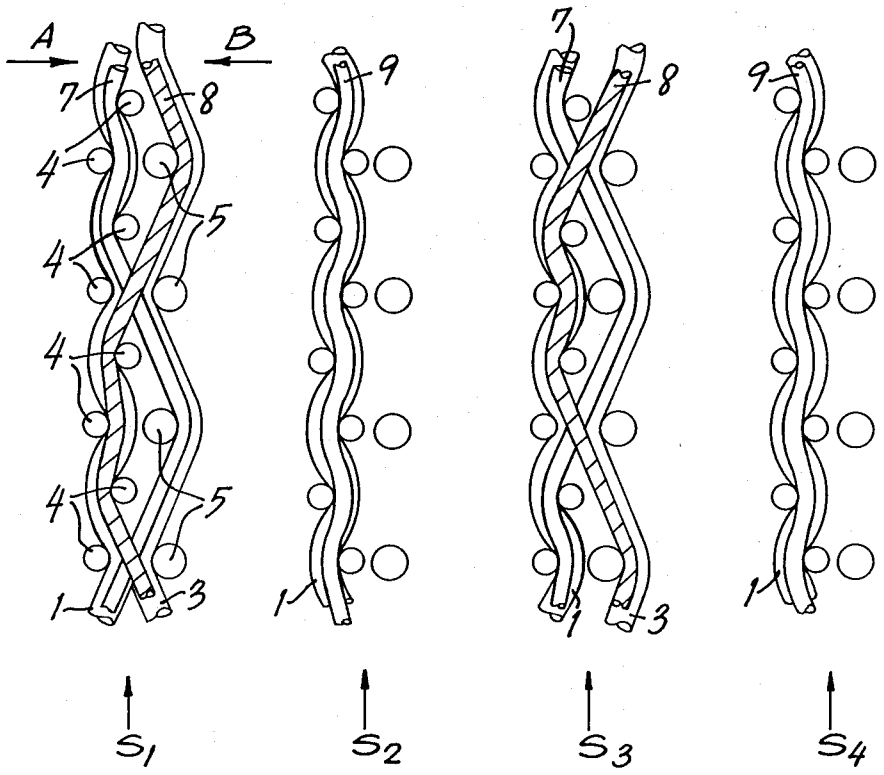
FIGS. 1 and 1*a* show a plan view and a plurality of longitudinal sectional views, S, through $S_4$, of a composite fabric according to the invention made of a fine-mesh linen weave forming fabric and a wide-mesh linen weave wear fabric, the sectional views being taken along the lines of the arrows in FIG. 1.
Figure 1:
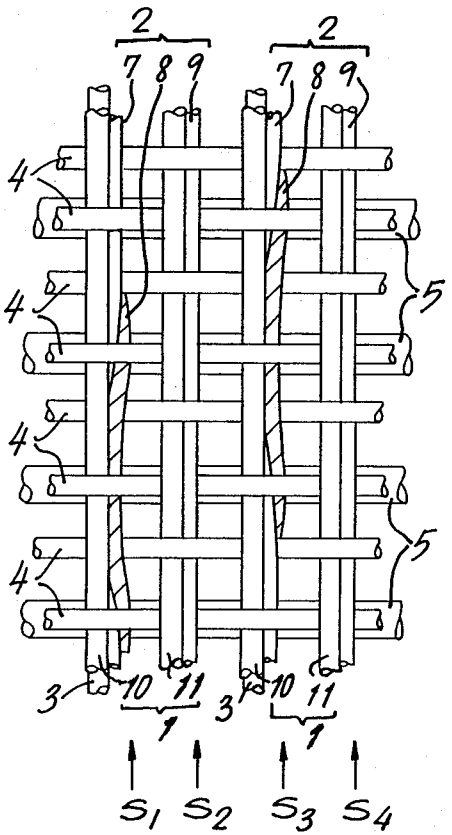
Figure 2A:
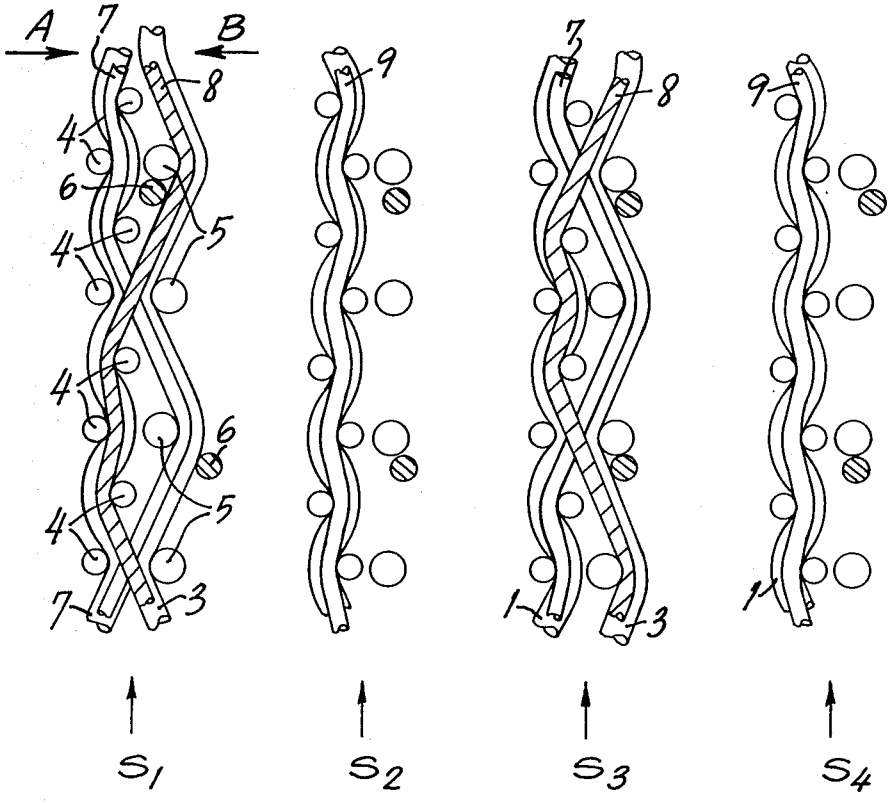
FIGS. 2 and 2*a* show a plan view and a plurality of longitudinal sectional views of a comprising fabric according to the invention comprising a wear fabric with a group of cross threads of highly wear-resistant material bound therein, the sectional views being taken along the lines of the arrows of FIG. 2.
Figure 2:
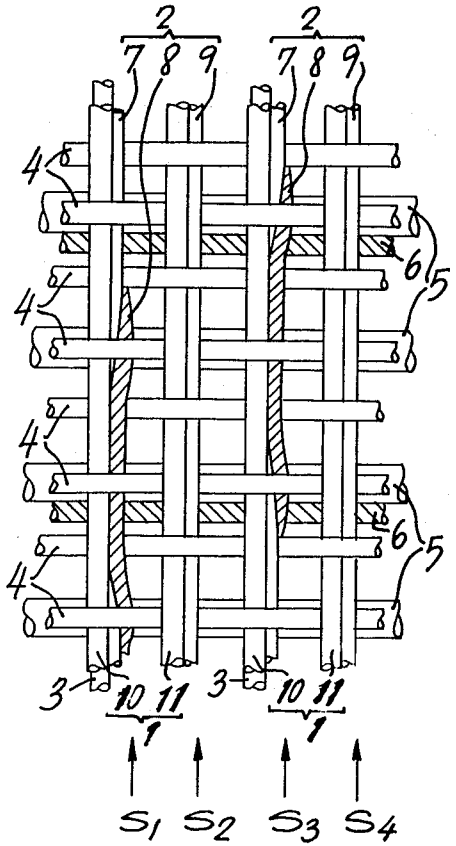

FIGS. 1 and 1*a* show a composite fabric composed of a fine-meshed linen-weave forming fabric and a wide-meshed wear fabric which is likewise a linen weave. The first set 1 and the second set 2 of warp or longitudinal threads are woven with the first set 4 of weft or cross theads to form a so-called plain weave in which all of the outwardly formed knuckles are formed from a warp thread, such as 10 and 11, a set 1 and a warp thread, such as 7, 8 and 9 of set 2, whereby the load exerted thereby on the weft threads of the first and second cross sets 4 and 5, which they span, will be equal throughout. This means, consequently, that no knuckles are exposed to increased tension and, therefore, there will be no depressions in the forming fabric that might cause markings in the paper. Joining of the upper fabric and the lower fabric is effected by the threads 7 and 8 which alternately interlace in the lower fabric. Although threads 9 are not interwoven with the lower fabric, they may at any time be replaced by threads 7 and 8;

FIGS. 2 and 2*a* show a preferred structure of a wear fabric having cross threads 6 of highly wear-resistant material bound therein. These wear threads 6 form elongated knuckles outwardly spanning three longitudinal or warp threads to thereby improve the weft runner properties of the wear fabric.

Figure 3:
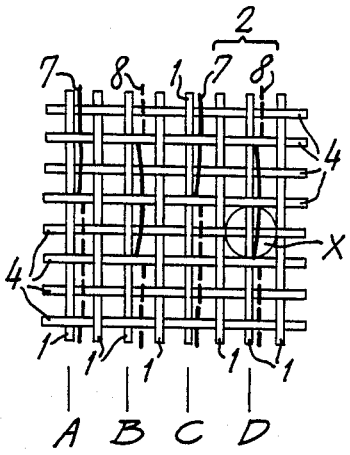
FIGS. 3 and 3*a* show plan views of the composite fabric according to the invention with two different degrees of fineness of the fabric, the knuckles x of the forming fabric and the knuckles y of the wear fabric being duplicate knuckles.
Figure 3A:
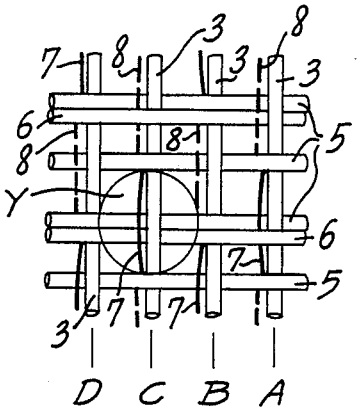

The FIGS. 3 and 3*a* illustrate an embodiment in which both the knuckles x of the forming fabric and the knuckles y of the wear fabric are duplicate knuckles, the mesh number of the foming fabric being four times that of the wear fabric. It is exactly these knuckles y that illustrate the extremely high number of binding points. The additional cross or transverse threads 6 of FIG. 3*a* span outwardly over three longitudinal threads of set 3.

Figure 4:
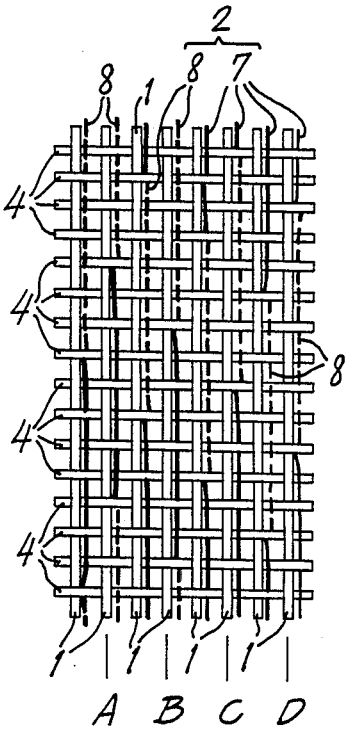
FIGS. 4 and 4*a* show plan views of the composite fabric according to the invention with two different degrees of fineness and different weaves, the wear fabric being a Batavia weave.
Figure 4B:
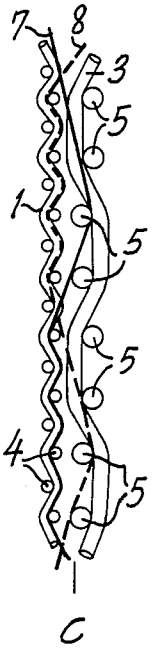
FIG. 4*b* shows in cross section taken across position C of the composite fabric shown in FIGS. 4 and 4*a*.
Figure 4A:
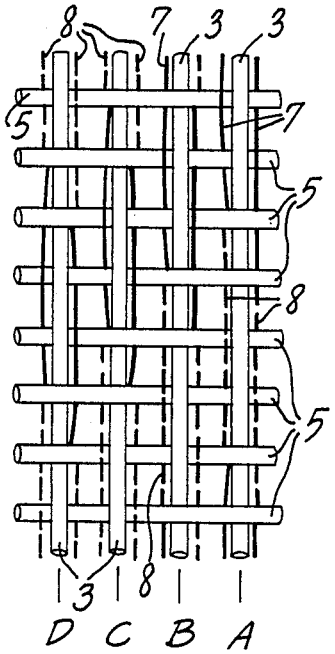

Of course, it will also be possible on the basis of the joining principle according to the invention to combine different-type weave fabrics with each other. Such a combination is illustrated in FIGS. 4 and 4*a*. Here, the wear fabric is a Batavia weave. The binding thread consists only of pairs of threads 7 and 8. The number of binding threads is therefore twice that of the number of warp threads of the upper fabric. It even exceeds the sum of all longitudinal or warp threads 1 and 3 of the two fabrics; here, too, the mesh number of the forming fabric is four times that of the wear fabric.

Whereas, with known composite fabrics of the above-specified kind, the number of binding threads is always essentially smaller than the number of threads of the forming fabric extending in the same direction, the number of binding threads is increased in a fabric according to the invention. For example it is doubled as explained above.

Thus, in a preferred embodiment of the paper making wire or screen according to the invention all outwardly disposed knuckles of the longitudinal or warp threads of the upper or forming fabric are double-woven whereby all of the knuckles of this fabric and not just a few of them are disturbed in the same way. Consequently, it is possible to practically eliminate all markings and also to achieve optimum distribution of the sum of binding forces to a maximum of binding points, whereby the load on each single binding point is minimized.

Of course, by the corresponding use of binder wefts it is also possible to make all outwardly disposed paper-facing weft knuckles into duplicate knuckles. Although the above-described binding principle in accordance with the invention would then be applied with a 90° offset, it would have the same effect while, of course, the weaving expenditure would be increased.

Having described the invention, it is to be understood that many modifications thereto will become apparent to those skilled in the art to which it pertains without departing from the spirit of the invention as defined by the following claims.

We claim:

1. A composite-type paper making wire or fabric comprising an upper or forming fabric and a lower or wear fabric including at least three sets of longitudinal threads and at least two sets of cross threads, characterized in that at least half of all outwardly disposed longitudinal knuckles of the upper fabric are formed of at least two sets of longitudinal threads forming double knuckles, the first set of longitudinal threads is woven with the first set of cross threads, the third set of longitudinal threads is woven with the second set of cross threads, and at least portions of the second set of longitudinal threads are woven with both sets of cross threads.

2. A paper making wire or fabric according to claim 1 wherein all of the outwardly disposed longitudinal knuckles of the upper fabric are formed from the first and second sets of longitudinal threads.

3. A paper making wire or fabric according to claim 1 wherein all of the threads of the second set of cross threads are woven with threads of the second set of longitudinal threads.

4. A paper making wire or fabric according to claim 3 wherein in addition to the second set of cross threads a set of wear-type cross threads is also provided which is likewise woven with the threads of the second set of longitudinal threads.

5. A paper making wire or fabric according to claim 1 wherein the knuckle distribution of the upper fabric corresponds to a linen weave.

6. A paper making wire or fabric according to claim 1 wherein the knuckle distribution of the lower fabric corresponds to a linen weave.

7. A paper making wire or fabric according to claim 6 wherein additional cross threads are woven into the lower fabric, said cross threads outwardly spanning at least three longitudinal threads.

8. A paper making wire or fabric according to claim 7 wherein the additional interwoven cross threads are made of a wear-resistant material.

9. A paper making wire or fabric according to claim 1 wherein at least a portion of the second set of longitudinal threads is made of an elongation material.

10. A paper making wire or fabric according to claim 9 wherein the diameter of the threads of the second set of longitudinal threads is not more than $\frac{3}{4}$ of the diameter of the threads of the first set of longitudinal threads.

11. A paper making wire or fabric according to claim 1 wherein the lower fabric is a Batavia weave.

* * * * *